United States Patent [19]

Giocolano

[11] 3,955,518

[45] May 11, 1976

[54] BELT TENSIONING MECHANISM FOR TILTABLE SEWING MACHINES

[75] Inventor: Santi Riccardo Giocolano, Staten Island, N.Y.

[73] Assignee: The Singer Company, New York, N.Y.

[22] Filed: Aug. 11, 1975

[21] Appl. No.: 603,571

[52] U.S. Cl. ..... 112/217.1; 112/220; 112/258

[51] Int. Cl.[2] ..... D05B 75/02

[58] Field of Search ..... 112/217.1, 217.2, 217.3, 112/258, 260, 67, 121.14, 220; 74/228, 242.15 R

[56] References Cited

UNITED STATES PATENTS

| | | | |
|---|---|---|---|
| 113,498 | 4/1871 | Chase | 112/258 |
| 1,160,986 | 11/1915 | Kiewicz | 112/220 X |
| 3,126,852 | 3/1964 | Fontana | 112/258 |

*Primary Examiner*—George H. Krizmanich
*Attorney, Agent, or Firm*—Robert E. Smith; Edward L. Bell; Julian Falk

[57] ABSTRACT

This disclosure relates to the combination of a sewing machine and a work table wherein the sewing machine is supported in the work table for movement between a sewing position and a tilted position, a drive motor supported remote from the driven mechanism of the machine and an idler pulley supported intermediate the drive motor and the machine with the idler pulley drivingly connecting the machine with the drive motor by means of drive belts, and the idler pulley being supported for movement with the sewing machine during tilting thereof in a manner whereby the tension in the drive belts is relieved during tilting of the sewing machine and tension is restored during return movement of the sewing machine to the sewing position.

3 Claims, 4 Drawing Figures

Fig. 1
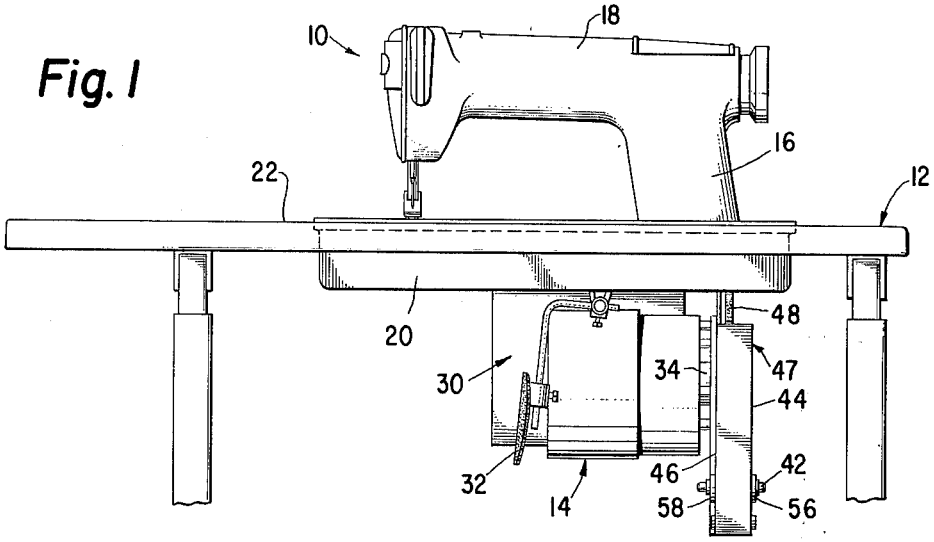
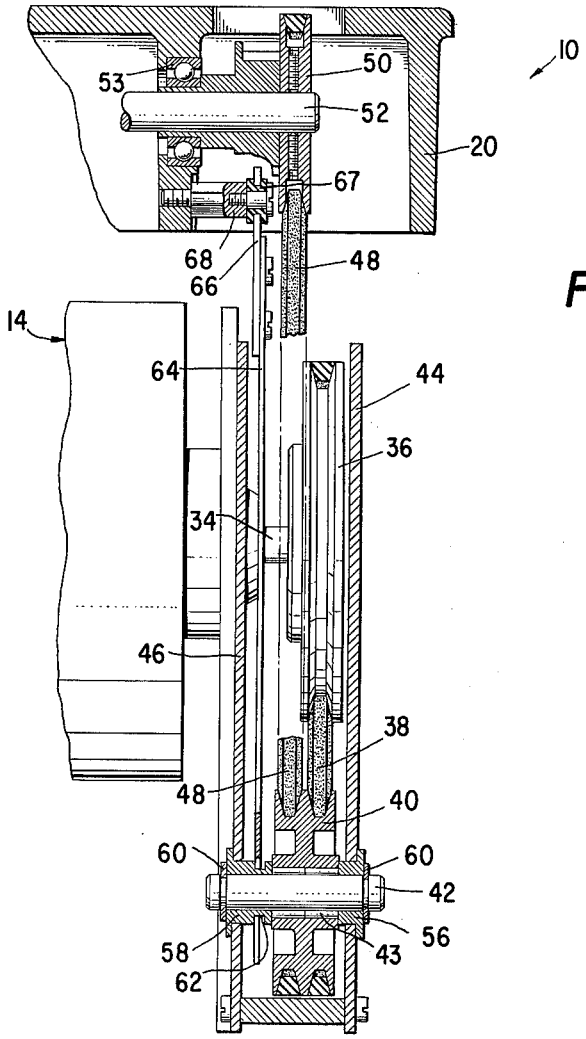
Fig. 2

BELT TENSIONING MECHANISM FOR TILTABLE SEWING MACHINES

BACKGROUND OF THE INVENTION

The present invention relates to sewing machines which are supported in a work table for tilting between a sewing position and an elevated position wherein the sewing machine may be serviced or the like.

It is common in the sewing industry to support a sewing machine in a work table with the work table also supporting a clutch motor beneath the surface thereof for driving the sewing machine upon actuation by the operator through a foot controller or the like. The clutch motor is connected to the sewing machine by means of a drive belt or belts which belts are usually under tension during operation thereof. As such sewing machines are usually heavy it is often difficult to elevate the sewing machine from the sewing position for inspecting or servicing the machine. Also, the difficulty of elevating the sewing machine is often increased due to the fact that the drive belts connecting the clutch motor and the machine are under tension and when it is desired to tilt the machine one must work against the tension of the belts to elevate the same. It is known in the art that the belts may be completely removed to elevate the sewing machine in order to overcome working against the tension of the belts. However, this is not entirely satisfactory since it is often difficult to get at the belts to remove them from the pulleys and also once the machine is returned to its operating position the belts must be reinstalled which is time consuming and may require the services of a skilled mechanic.

SUMMARY OF THE INVENTION

According to the present invention, a belt tensioning mechanism is provided which maintains the drive belts under tension during operation of the sewing machine but relieves the tension on the belts during elevation of the machine for servicing or the like. The operation of the invention is such that when the machine is tilted to an elevated position the belts need not be removed while at the same time the tension in the belts is released so as not to provide a force from the belts opposing the effort of the person lifting the machine.

The present invention is carried out by providing an idler pulley disposed intermediate of the clutch motor and the driving mechanism of the sewing machine for supporting the drive belts and which idler pulley is also supported for movement along a fixed path with the sewing machine during elevation thereof to the tilted position. The fixed path of movement of the idler pulley is selected such that during elevation of the sewing machine to the tilted position the distances between the axis of the clutch motor and the idler pulley and the axis of the idler pulley and the driven mechanism of the sewing machine will decrease so that the tension in the belts will be relieved during said elevation. During return movement of the sewing machine to a working or sewing position, the path of the idler pulley is such that the aforementioned distances will increase whereby tension in the belts will be automatically restored.

Accordingly, it is one object of the invention to provide a novel and improved belt tensioning mechanism for a tiltable sewing machine.

It is another object of the invention to provide a novel and improved mechanism to permit easy tilting of a sewing machine from a work table surface without requiring any removal of the drive belts or handling or adjustment of parts therefore.

It is a further object of the invention to provide a novel and improved belt tensioning mechanism for a tiltable sewing machine wherein, during tilting of the sewing machine, tension on the drive belts is relieved and upon return of the sewing machine to a sewing position tension in the drive belts is automatically restored.

It is still another object of the invention to provide a novel and improved mechanism for permitting quick and easy disconnecting of the sewing machine from the work table and associated drive mechanism.

Other objects and advantages of the invention will be best understood when reading the following detailed description of the preferred embodiment of the invention with the accompanying drawings.

BRIEF DESCRIPTION OF THE DRAWINGS

FIG. 1 represents a front plan view of a sewing machine supported in a work table;

FIG. 2 is an enlarged partial sectional view of the invention showing a portion of the drive mechanism of the sewing machine of FIG. 1;

DETAILED DESCRIPTION OF THE INVENTION

Figure 4:
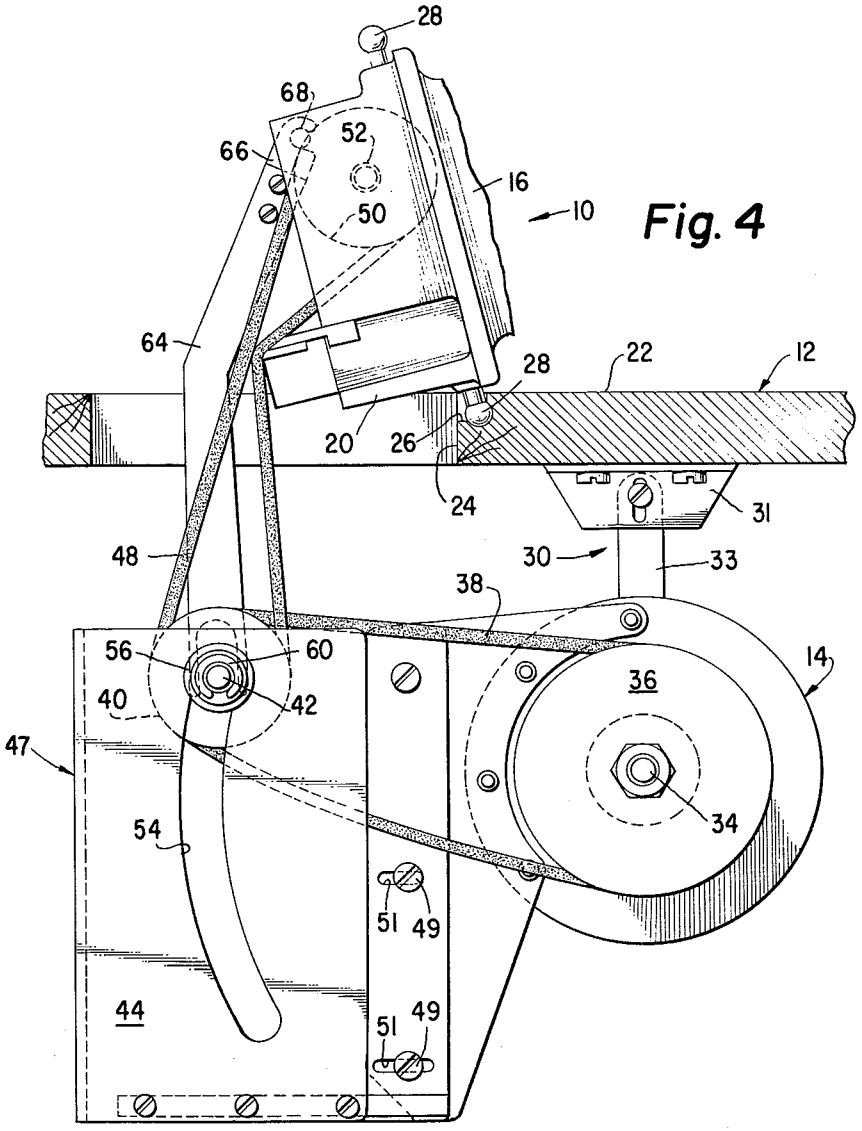
FIG. 4 is a view similar to that shown in FIG. 3 but illustrating the sewing machine in the elevated or tilted position.

Referring to the drawings in particular FIG. 1, there is shown therein a sewing machine 10 supported in a work table 12 which also supports a clutch motor 14 for driving the sewing machine in a manner which is known in the art and which will be more fully referred to hereinafter. The sewing machine 10 includes a standard 16 supporting an arm 18 which supports and contains the standard sewing mechanism of the sewing machine. The sewing machine 10 also includes a base member 20 which supports the standard 16 and arm 18 and in turn is supported in the table top 22 of the table 12. The top 22 is provided with a sewing machine opening 24 (FIGS. 3 and 4) and also includes indentations or sockets 26 for receiving ball members 28 affixed to the base 20. Preferrably there are three ball members 28 provided on the base 20, there being two spaced ball members 28 adjacent each end of the rear portion of the sewing machine base member 20, or the right hand side as viewed in FIGS. 3 and 4, and one such ball member 28 positioned substantially at the center portion of the base 20 so as to provide a tripod-like support for the sewing machine in the work table top 22.

Figure 3:
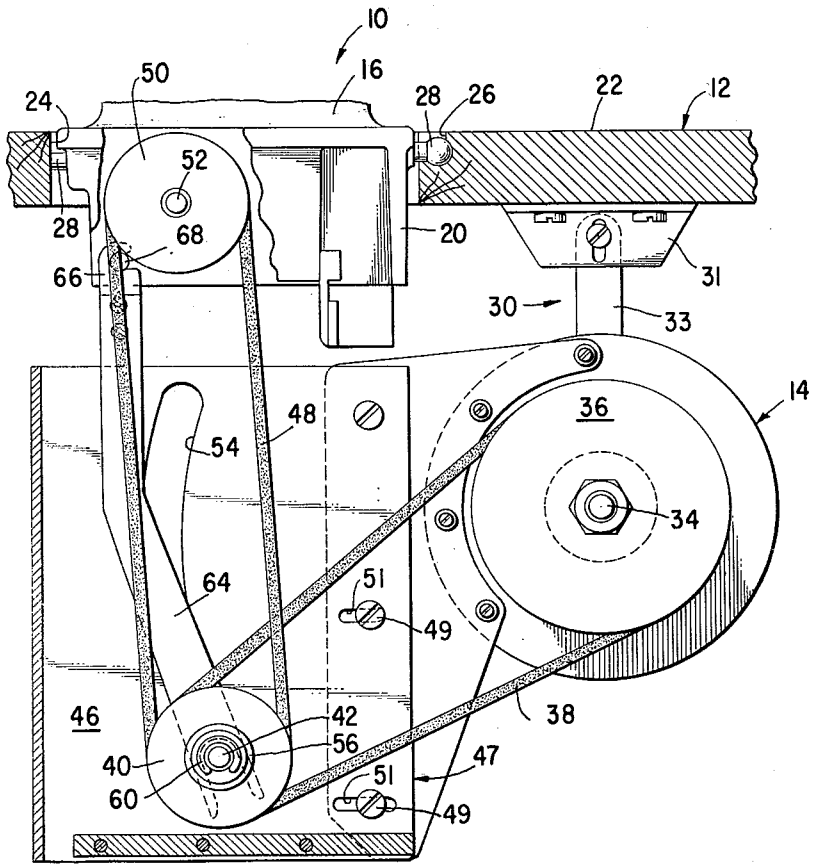
FIG. 3 is an enlarged end view partially in section of the combination shown in FIG. 1 including a portion of the sewing machine thereof illustrated in the sewing position.

The clutch motor 14 is supported in a frame structure 30 which in turn is suitably fixed to the work table 12. The frame structure 30 which is provided between the clutch motor 14 and table 12 may comprise a block 31 on table 12 bolted to an arm 33 extending from the clutch motor housing. The arm 33 is adjustable relative to the block 31 for permitting adjustment of the tension in the drive belt 48 by adjusting the clutch motor upwardly or downwardly. The clutch motor 14 is of the standard type found in the industry which provides on-off type operation for the sewing machine 10 in accordance with manual actuation by an operator as by a knee actuator 32 or suitable treadle device (not shown). The clutch motor 14 includes a main shaft 34 on which is fixed for rotation therewith a pulley 36. The pulley 36 carries a motor drive belt 38 and connects the pulley 36 with one side of a double idler pulley 40 which is supported for rotation about a shaft 42 as by bearings 43. The shaft 42 is supported in a pair of spaced walls 44 and 46 of the belt housing 47 for movement relative thereto as will be more fully explained below. As also seen in FIGS. 3 and 4 the belt housing 47 is connected by screws 49 in slots 51 to the clutch motor section of the housing 47 for permitting adjustment therebetween to adjust the tension in belt 38. The machine drive belt 48 is carried by the other side of the double pulley 40 and extends around a pulley 50 which is fixed to the drive shaft 52 for the sewing machine 10. As illustrated in FIG. 2, the machine drive shaft 52 is supported for rotation in the base 20 of the machine frame as by ball bearings 53 or the like. As will be apparent, when the operator actuates the knee actuator 32 the clutch motor will drive the pulley 36 fixed to the shaft 34 to drive the belt 38 and pulley 40 which in turn drives the belt 48 to drive the machine pulley 50 and the drive shaft 52 for transmitting power from the clutch motor 14 to the various elements of the sewing machine such as the sewing mechanism and feed mechanism.

It is often necessary to tilt the sewing machine from the sewing position illustrated in FIG. 3 to an elevated or tilted position illustrated in FIG. 4 as for inspection or servicing or the like. Because the drive belts between the clutch motor and the sewing machine must be under tension in order to properly transmit power, it is very difficult to raise or tilt the sewing machine without somehow releasing the tension as, for example, by disconnecting or removing a belt or the belts connected to the sewing machine drive mechanism. Removing the belts is often very time consuming and can be dangerous, and usually requires the services of a skilled serviceman. As will be apparent from the description found hereinafter, the present invention provides a means for relatively quickly raising or tilting the sewing machine without disconnecting any of the belts and with a minimum of difficulty.

Referring now particularly to FIGS. 2 – 4, it will be seen that the shaft 42 and its double idler pulley 40 are supported in a slot 54 in walls 44 and 46. As best seen in FIG. 2, the shaft 42 is supported by a pair of bushings 56 and 58 in the said slot 54 and "C" - rings 60 are disposed at each axial end of the shaft 42 for maintaining the bushings 56 and 58 in place relative to the shaft 42 and the slot 54. The bushing 58 includes an annular groove 62 in which is positioned the slotted end of a lock rod 64. The opposite end of the lock rod 64 is provided with a hook portion 66 for detachably engaging an annular grooved elastomeric shock absorbing member 67 mounted on a protruding stud 68 suitably fixed to the base member 20 and extending therefrom for receiving the hook portion 66. The hook portion of the lock rod 64 is adjustable relative to the main body of the rod 64 and is provided with screws and slotted portions for providing a lengthwise adjustment of the hook end relative lock rod main body in order to accommodate variations in the positions of the stud portion 68 for different machines or the like. Thus it will be apparent that there is provided a rigid connection between the sewing machine base 20 and the double idler pulley 40 so that any initiation of movement of the lock rod 64 in a substantially vertical path will cause initiation of a similar movement to the pulley 40.

With reference to FIGS. 3 and 4 it will be seen that when the machine is tilted from a sewing position to an elevated position in FIG. 4 the lock rod 64 will be raised as it is hooked to the machine base 20 and in turn will cause the double idler pulley 40 to follow. As the double idler pulley 40 is positioned within the slot 54 its movement will be restrained to the shape of the slot. The slotted end of the lock rod 64 which contains the double idler pulley 40 permits for some relative movement between the lock rod 64 and said pulley 40 in order to accommodate differences in the path of movement. As further seen in FIGS. 3 and 4 the slot 54 has a substantially curved path. The curved or arcuate shape of the slot 54 is generated about an axis which is offset from the axis of the clutch motor 14 and the axis of the machine drive shaft 52. The site of the axis of the curved slot 54 is chosen such that the path of travel of the pulley 40 will be such that as the machine is elevated the distance between the axis of the clutch motor 14 and the axis of the pulley 40 and the distance between the axis of machine drive shaft 52 and the axis of the pulley 40 will decrease.

It will be apparent therefore that as the machine is raised and the pulley 40 travels upwardly in the slot 54 the tension in the belt 38 between the clutch motor 14 and the pulley 40 and the tension in the belt 48 between the pulley 50 and the pulley 40 will be relieved or decreased. Therefore, as the operator or the serviceman lifts the machine the tension in the belts will not add any restraint to said lifting thereby removing this factor from the difficulty in raising the sewing machine to the elevated position. Thus, the machine may be elevated relatively easily and without requiring removal of either of the belts 38 or 48. When any inspection or servicing is completed, the operator or serviceman need only lower the machine to the sewing position wherein the lock rod 64 will cause the pulley 40 to travel downwardly or in a return path along slot 54 and which during such return the tension in the belts 38 and 40 will be restored to their former condition. If it is desired to completely remove the machine from the table 12, it is only necessary to swing the machine upwardly as seen in FIG. 4 and pull the lock rod 64 to the left or towards the front of the machine as viewed in FIGS. 3 and 4 wherein the hook end portion of the lock arm 64 will be removed from the annular shock absorber 67 on stud 68. At that time the lock rod 64 is raised along with pulley 40 to relieve tension in the belt 48 and the belt 48 can be removed from pulley 50 and the machine completely removed from the opening 24 in the table top 22.

It will be apparent from the above description that a novel and improved belt tensioning means for a tiltable sewing machine is provided wherein the machine can be relatively easily elevated within a work table without requiring removal of any belts and wherein the tension in the belts is relieved so as not to provide an opposing force to the lifting thereof. When the sewing machine is returned to its original sewing position the tension in the belts is automatically restored so that no time need be wasted in replacing belts on pulleys or in adjusting the tension. While the invention has been described in its preferred embodiment it will be apparent to those skilled in the art that various modifications and changes may be made without departing from the spirit and scope as defined in the appended claims.

Having thus described the nature of the invention, what we claim herein is:

1. The combination of a sewing machine and a work table comprising, a work table, a sewing machine including a frame supported in said work table for movement between a sewing position wherein the work surface of the machine is substantially parallel to the table surface and a tilted position wherein the work surface of the machine is tilted away from the table surface, a drive motor supported remote from the machine, an idler pulley supported between said drive motor and said machine for operably connecting said drive motor to said machine for driving the sewing elements of said machine, a first belt operably connecting said drive motor to said idler pulley, a second belt operably connecting said idler pulley to said machine, and said idler pulley being supported for movement in a fixed path relative to said drive motor and said machine with said fixed path being such that during tilting of said sewing machine the movement of said idler pulley will be such that the effective distance between said idler pulley and said drive motor and said sewing machine will decrease whereby the tension on said first and second belts will be relieved.

2. The combination as set forth in claim 1 wherein said idler pulley is supported for rotation and movement relative to a supporting frame, said frame including a curved slot in which said idler pulley is disposed, and said curve slot having a radius of curvature whose axis is offset with respect to the axis of said drive motor and a driven element on said sewing machine.

3. The combination as set forth in claim 2 further comprising a locking arm detachably secured at one end thereof to said sewing machine frame, said locking arm supporting said pulley for movement therewith in response to tilting of the sewing machine between the sewing position and the tilted position.

* * * * *